US008205474B2

(12) United States Patent
Britanik et al.

(10) Patent No.: US 8,205,474 B2
(45) **Date of Patent: *Jun. 26, 2012**

(54) METHOD AND PLANT FOR INTEGRATED MONITORING AND CONTROL OF STRIP FLATNESS AND STRIP PROFILE

(75) Inventors: Richard Britanik, Sarver, PA (US); Tino Domanti, Coal Point (AU); Terry L. Gerber, Lisbon, OH (US); Jason A. Mueller, McDonald, PA (US); Glen Wallace, Whitebridge (AU); Harold Bradley Rees, Ladoga, IN (US)

(73) Assignee: Nucor Corporation, Charlotte, NC (US)

( * ) Notice: Subject to any disclaimer, the term of this patent is extended or adjusted under 35 U.S.C. 154(b) by 773 days.

This patent is subject to a terminal disclaimer.

(21) Appl. No.: 12/332,040

(22) Filed: Dec. 10, 2008

(65) Prior Publication Data

US 2009/0139290 A1 Jun. 4, 2009

Related U.S. Application Data

(63) Continuation-in-part of application No. 11/625,031, filed on Jan. 19, 2007, now Pat. No. 7,849,722.

(60) Provisional application No. 60/780,326, filed on Mar. 8, 2006.

(51) Int. Cl.
*B21D 37/00* (2006.01)
*B21B 37/58* (2006.01)

(52) U.S. Cl. ..... 72/9.2; 72/11.8; 29/527; 29/7; 700/154

(58) Field of Classification Search ..... 72/9.2, 72/9.4, 11.8, 16.9, 18.8; 29/527.7; 700/154, 700/155

See application file for complete search history.

(56) References Cited

U.S. PATENT DOCUMENTS 4,261,190 A 4/1981 Fapiano
4,537,050 A 8/1985 Bryant et al.
4,809,527 A 3/1989 Mitchell (Continued)

FOREIGN PATENT DOCUMENTS

DE 2743130 6/1978

(Continued)

OTHER PUBLICATIONS

Arif S. Malik and Remn-Min Guo, Roll Profile Optimization Using Linear Programming Method, AISE Steel Technology; 2003, vol. 80, n4, pp. 46-53.

(Continued)

*Primary Examiner* — David Jones
(74) *Attorney, Agent, or Firm* — Hahn Loeser & Parks LLP

(57) ABSTRACT

Apparatus and method of controlling strip geometry in casting strip having a rolling mill. A target thickness profile is calculated as a function of the measured entry thickness profile of the strip while satisfying profile and flatness parameters. A differential strain feedback from longitudinal strain in the strip is calculated by a control system by comparing the exit thickness profile with the target thickness profile, and a control signal is generated to control a device capable of affecting the geometry of the strip processed by the hot rolling mill. A feed-forward control reference and/or sensitivity vector may also be calculated as a function of the target thickness profile, and used in generating the control signal sent to the control device. The control device may be selected from one or more of the group consisting of a bending controller, gap controller and coolant controller.

28 Claims, 7 Drawing Sheets

U.S. PATENT DOCUMENTS

| | | | |
|---|---|---|---|
| 5,086,399 | A | 2/1992 | Tsugeno |
| 5,241,847 | A | 9/1993 | Tsugeno |
| 5,493,885 | A | 2/1996 | Nomura et al. |
| 5,546,779 | A | 8/1996 | Ginzburg |
| 5,651,281 | A | 7/1997 | Seidel |
| 5,775,154 | A | 7/1998 | Haberkamm |
| 5,860,304 | A | 1/1999 | Anbe et al. |
| 5,875,663 | A | 3/1999 | Tateno et al. |
| 5,970,765 | A | 10/1999 | Seidel |
| 6,006,574 | A | 12/1999 | Armenat |
| 6,044,895 | A | 4/2000 | Kuttner et al. |
| 6,216,505 | B1 | 4/2001 | Hiramatsu |
| 6,286,349 | B1 | 9/2001 | Muller et al. |
| 6,314,776 | B1 | 11/2001 | Puda |
| 6,314,782 | B1 | 11/2001 | Stahl |
| 6,868,895 | B2 | 3/2005 | Izu et al. |
| 7,181,822 | B2 | 2/2007 | Ondrovic et al. |
| 7,317,542 | B2 | 1/2008 | Krambeer et al. |
| 7,531,257 | B2 | 5/2009 | Sugawara et al. |
| 2001/0029848 | A1 | 10/2001 | Lemper |
| 2007/0006625 | A1 | 1/2007 | Reinschke |
| 2007/0220939 | A1 | 9/2007 | Britanik et al. |
| 2009/0049882 | A1 | 2/2009 | Flick et al. |

FOREIGN PATENT DOCUMENTS

| | | | |
|---|---|---|---|
| DE | 3721746 | | 1/1989 |
| EP | 0108379 | | 5/1984 |
| EP | 1481742 | | 12/2004 |
| JP | 61-001418 | | 1/1986 |
| JP | 61-049722 | | 3/1986 |
| JP | 06091311 | | 4/1994 |
| JP | 9168809 | | 6/1997 |
| JP | 9174129 | | 7/1997 |
| JP | 2002126811 | | 5/2002 |
| KR | 2003-054637 | | 7/2003 |
| RU | 2115494 | | 7/1998 |
| RU | 2154541 | | 8/2000 |
| SU | 1705072 | A1 | 1/1992 |
| WO | 9515233 | | 6/1995 |
| WO | 9534388 | | 12/1995 |
| WO | 02090012 | | 11/2002 |

OTHER PUBLICATIONS

Wanda M. Melfo, Rian J. Dippenaar, and Christopher D. Carter, Ridge-buckle Defect in Thin-Rolled Steel Strip, Iron & Steel Technology, Aug. 2006, 54-61, AISTech 2005 Proceedings.

P.J. Reeve, A.F. MacAlister, and T.S. Bilkhu, Control, Automation and Hot Rolling of Steel, Phil. Trans. R. Soc. Lond A. (1999) 357, 1549-1571, Great Britain.

G. Boulton, SA Dominati, WJ Edwards, PJ Thomas, GA Wallace and M Kridner; Exploring Aspects of Flatness and Profile Control; Jun. 20, 2006, 9th International Steel Rolling Congress.

Thomas F. Hazen, P.E. Partner, Eric Theis; The What, Why and How of Tension Leveling; pp. 46-50 and 59-63. Jan. 2004, Modern Metals.

Bob Beal; The Art of Engineering, Rolling Mill Metal Shape, Pfeiffer Engineering, 2001.

Dipl.-Ing. Jörg Börchers; Top Plan Topometric Flatness Measurement; Design, Function, Calibration; 2002 IMS GmbH.

Eric Theis, Consultants to the Industry; Oct. 17, 2008, Expertise in Flat Rolled Leveling; Yield Strains vs "I-Units" of flatness; pp. 1-4.

Thomas F. Hazen, P.E., Eric Theis; The What, Why and How of Tension Leveling; Apr. 2004; Modern Metals; pp. 48-50.

METHOD AND PLANT FOR INTEGRATED MONITORING AND CONTROL OF STRIP FLATNESS AND STRIP PROFILE

CROSS-REFERENCE TO RELATED APPLICATIONS

This patent application is a continuation-in-part of U.S. patent application Ser. No. 11/625,031 which was filed on Jan. 19, 2007, which claims priority to and the benefit of U.S. Provisional Patent Application Ser. No. 60/780,326 which was filed on Mar. 8, 2006, the entirety of both of which are incorporated herein by reference.

BACKGROUND AND SUMMARY

In continuous casting of thin steel strip, molten metal is cast directly by casting rolls into thin strip. The shape of the thin cast strip is determined by, among other things, the surface of the casting surfaces of the casting rolls.

In a twin roll caster, molten metal is introduced between a pair of counter-rotated laterally positioned casting rolls, which are internally cooled, so that metal shells solidify on the moving casting roll surfaces and are brought together at the nip between the casting rolls to produce a thin cast strip product. The term "nip" is used herein to refer to the general region at which the casting rolls are closest together. The molten metal may be poured from a ladle through a metal delivery system comprised of a moveable tundish and a core nozzle located above the nip, to form a casting pool of molten metal supported on the casting surfaces of the rolls above the nip and extending along the length of the nip. This casting pool is usually confined between refractory side plates or dams held in sliding engagement with the end surfaces of the casting rolls so as to restrain the two ends of the casting pool.

The thin cast strip passes downwardly through the nip between the casting rolls and then into a transient path across a guide table to a pinch roll stand. After exiting the pinch roll stand, the thin cast strip passes into and through a hot rolling mill where the geometry (e.g., thickness, profile, flatness) of the strip may be modified in a controlled manner.

The "measured" strip flatness and tension profile as measured at a device downstream of the hot rolling mill are insufficient to control in practice the hot rolling mill because, unlike cold mills (where the measured downstream flatness or tension profile of the strip closely resembles the flatness or tension profile produced off the mill), the flatness or tension profile may differ due to the action of creep. At elevated temperatures, steel undergoes plastic deformation in response to the tension stress at the entry and exit of the rolling mill in the form of creep. The plastic deformation occurring outside the roll gap in the regions where the strip enters and exits the mill causes changes in the entry and exit tension stress profiles and strip flatness, as well as strip profile.

The high strip temperature at the exit of steel hot mills also makes difficult the measurement of the strip flatness or tension stress profile by direct contact. Non-contact optical methods for flatness measurement have been used. However, such non-contact flatness measurement results in partial flatness measurement, since at any given time only part of the strip exhibits measured flatness defects. In addition, creep in the strip results in the flatness of the strip at the roll stand exit likely being significantly worse than that measured downstream at practical flatness gauge locations.

In twin roll casting of thin strip, the cast strip is thinner than typically found in traditional strip in hot mills. Typically in twin roll casting, the thin strip is cast at a thickness of about 1.8 to 1.6 mm and rolled to a thickness between 1.4 and 0.8 mm. The strip entry temperature to the hot mill is higher than found in the final stand of the typical hot mill, approximately 1100° C. A consequence of thin strip high temperature and casting process is that the strip entry tension is low, and therefore is more susceptible to buckling and creep prior to entry into the hot mill. In addition, in thin strip casting, it is desirable to produce strip of a desired strip profile while maintaining acceptable flatness, since the product may be used as cold rolled replacement. The strip geometry is largely controlled by the caster. Low tensions employed in hot rolling mills results in small local roll-gap errors and loss of tension stress at points across the strip width, and results in strip buckles and poor strip flatness. We have found that tension stress provides a way to control the strip flatness.

A method is disclosed for controlling strip geometry in casting strip having a hot rolling mill comprising:

measuring an entry thickness profile of an incoming metal strip before the metal strip enters the hot rolling mill;

calculating a target thickness profile as a function of the measured entry thickness profile while satisfying desired profile and flatness parameters;

measuring an exit thickness profile of the metal strip after the metal strip exits the hot rolling mill;

calculating a differential strain feed back from longitudinal strain in the strip by comparing the exit thickness profile with the target thickness profile; and controlling a device capable of affecting the geometry of the strip exiting the hot rolling mill in response to at least the differential strain feed-back.

The method of controlling strip geometry in casting strip having a hot rolling mill may further comprise:

calculating a roll gap pressure profile from the entry thickness profile and dimensions and characteristics of the hot rolling mill;

calculating a feed-forward control reference and/or a sensitivity vector as a function of the target thickness profile and the roll gap pressure profile to allow compensation for profile and flatness fluctuations in the cast strip; and further controlling the device capable of affecting the geometry of the strip exiting the hot rolling mill in response to the calculated feed-forward control reference and/or the calculated sensitivity vector.

The method may comprise the steps of:

measuring a strip flatness measurement after the metal strip exits the hot rolling mill; and where calculating a differential strain feed back comprises incorporating the strip flatness measurement with a difference between the exit thickness profile and the target thickness profile.

Alternately or in addition, the method may comprise:

determining an allowable flatness error range, and where calculating a differential strain feed back comprises improving the exit thickness profile without controlling flatness within the allowable flatness error range.

The profile and flatness parameters may be selected so that the target thickness profile inhibits local strip buckling. Alternately or in addition, the target thickness profile may be calculated as a function of a change in geometry of the metal strip to achieve the target thickness profile without producing local strip buckling. The device capable of affecting the geometry of the strip exiting the hot rolling mill may be selected from one or more of the group consisting of a bending controller, a gap controller, a coolant controller, and other devices capable of modifying the loaded roll gap of the hot rolling mill.

The method of controlling strip geometry in casting strip having a hot rolling mill may further comprise the step of generating an adaptive roll gap error vector from the measured exit thickness profile and using the adaptive roll gap error vector in calculating at least one of the feed-forward control reference and the sensitivity vector.

The method of controlling strip geometry in casting strip having a hot rolling mill may further include the step of calculating the target thickness profile by performing at least one of time filtering and spatial frequency filtering.

The method of controlling strip geometry in casting strip having a hot rolling mill may also have the controlling step include performing symmetric feed-back control and asymmetric feed-back control of the bending controller and the gap controller. The controlling step may alternatively, or in addition, include subtracting out systematic measurement errors from the differential strain feed back when the rolling mill is engaged, the systematic measurement errors being generated through comparison of the entry and exit thickness profiles when the rolling mill is disengaged. The controlling step may also include performing temperature compensation and buckle detection, or performing at least one of operator-induced coolant trimming and operator-induced bending trimming.

The method for controlling strip geometry in casting strip having a hot rolling mill may be used in continuous casting by twin roll caster comprising the following steps:

(a) assembling a thin strip caster having a pair of casting rolls having a nip therebetween;

(b) assembling a metal delivery system capable of forming a casting pool between the casting rolls above the nip with side dams adjacent the ends of the nip to confine the casting pool;

(c) assembling a hot rolling mill having work rolls with work surfaces forming a roll gap between them through which incoming hot strip from the thin strip caster is rolled, the work rolls having work roll surfaces relating to a desired shape across the work rolls;

(d) assembling a device capable of affecting the geometry of the strip exiting the hot rolling mill in response to control signals;

(e) assembling a control system capable of calculating a differential strain feed-back from longitudinal strain in the strip by comparing a exit thickness profile with a target thickness profile derived from a measured entry thickness profile, and generating control signals in response to the calculated differential strain feed-back;

(f) connecting the control system to the device capable of affecting the geometry of the strip exiting the hot rolling mill in response to the generated control signals from the control system.

To perform the method in a twin roll caster molten steel may be introduced between the pair of casting rolls to form a casting pool supported on casting surfaces of the casting rolls confined by the side dams, and the casting rolls counter-rotated to form solidified metal shells on the surfaces of the casting rolls and cast thin steel strip through the nip between the casting rolls from the solidified shells. The device affecting the geometry of the strip being processed by the hot rolling mill may be capable of varying the roll gap of the work rolls, bending by the work rolls, and/or coolant provided to the work rolls in response to at least one of the control signals, to affect the geometry of the hot strip exiting the hot rolling mill.

Also disclosed is a control architecture for controlling strip geometry in casting strip having a hot rolling mill comprising:

an entry gauge apparatus capable of measuring an entry thickness profile of an incoming metal strip before the metal strip enters the rolling mill;

a target thickness profile model capable of calculating a target thickness profile as a function of the measured entry thickness profile while satisfying desired profile and flatness parameters;

an exit gauge apparatus capable of measuring an exit thickness profile of the metal strip after the metal strip exits the rolling mill;

a differential strain feed back model capable of calculating a differential strain feed-back from longitudinal strain in the strip by comparing the exit thickness profile with the target thickness profile; and a control model capable of controlling a device capable of affecting the geometry of the strip exiting the hot rolling mill in response to the differential strain feed back.

The target thickness profile model may inhibit strip buckling. The differential strain feed back model may also include temperature compensation capability and buckle detection capability. The differential strain feed back model further may include an automatic nulling capability capable of subtracting out systematic errors from the differential strain feed back when the rolling mill is engaged, the systematic errors being generated through comparison of the entry and exit thickness profiles when the rolling mill is disengaged.

The control architecture for controlling strip geometry in casting strip having a hot rolling mill may further comprise:

a roll-gap model capable of calculating a roll gap pressure profile from the entry thickness profile and dimensions and characteristics of the hot rolling mill, and a feed-forward roll stack deflection model capable of calculating a feed-forward control reference and/or a sensitivity vector as a function of the target thickness profile and the roll gap pressure profile to allow compensation for profile and flatness fluctuations in the cast strip.

The adaptive roll stack deflection model may be capable of generating an adaptive roll gap error vector from the measured exit thickness profile and using the adaptive roll gap error vector in calculating at least one of the feed-forward control reference and the sensitivity vector. The target thickness profile model may further include at least one of time filtering capability and spatial frequency filtering capability as part of calculating the target thickness profile. The control model may include a symmetric feed back capability and an asymmetric feed back capability for controlling the bending controller and the gap controller.

The control architecture may comprise a flatness measuring device capable of measuring the flatness of the metal strip after the metal strip exits the rolling mill, and where the differential strain feed back model is capable of calculating the differential strain feed back comprising incorporating the strip flatness measurement with a difference between the exit thickness profile and the target thickness profile Alternately or in addition, the control architecture may include the differential strain feed back model capable of receiving an allowable flatness error range, and the differential strain feed back model capable of calculating a differential strain feed back improving the exit thickness profile without controlling flatness within the allowable flatness error range.

Again, the device capable of affecting the geometry of the strip exiting the hot rolling mill may be selected from one or more of the group consisting of a bending controller, a gap controller, and a coolant controller. The control architecture may also support at least one of operator-induced coolant trimming and operator-induced bending trimming.

The control architecture may be provided in a thin cast strip plant for continuously producing thin cast strip to controlled strip geometry which comprises:

(a) a thin strip caster having a pair of casting rolls having a nip therebetween;

(b) a metal delivery system capable of forming a casting pool between the casting rolls above the nip with side dams adjacent the ends of the nip to confine the casting pool;

(c) a drive capable of counter-rotating the casting rolls to form solidified metal shells on the surfaces of the casting rolls and cast thin steel strip through the nip between the casting rolls from the solidified shells;

(d) a hot rolling mill having work rolls with work surfaces forming a roll gap between through which cast strip from the thin strip caster may be rolled;

(e) a device connected to the hot rolling mill capable of affecting the geometry of the strip processed by the hot rolling mill in response to control signals; and (f) a control system capable of calculating a differential strain feed-back from longitudinal strain in the strip by comparing an exit thickness profile with a target thickness profile derived from a measured entry thickness profile, capable of generating the control signals in response the differential strain feed-back, and connected to the device to cause the device to affect the geometry of strip processed by the hot rolling mill in response to the control signals.

In the thin cast strip plant for producing thin cast strip with a controlled strip geometry by continuous casting, the control system may further be capable of calculating a feed-forward control reference and a sensitivity vector, and further capable of generating the control signals, the feed-forward control reference, and the sensitivity vector. The feed-forward control reference and the sensitivity vector are calculated as a function of a target thickness profile, derived from a measured entry thickness profile, and a roll gap pressure profile to allow compensation for profile and flatness fluctuations in the cast strip.

These and other advantages and novel features of the present invention, as well as details of illustrated embodiments thereof, will be more fully understood from the following description and drawings.

BRIEF DESCRIPTION OF THE DRAWINGS

FIG. 2 interfacing to the rolling mill of FIG. 1 and FIG. 2;

DETAILED DESCRIPTION OF THE DRAWINGS

Figure 1:
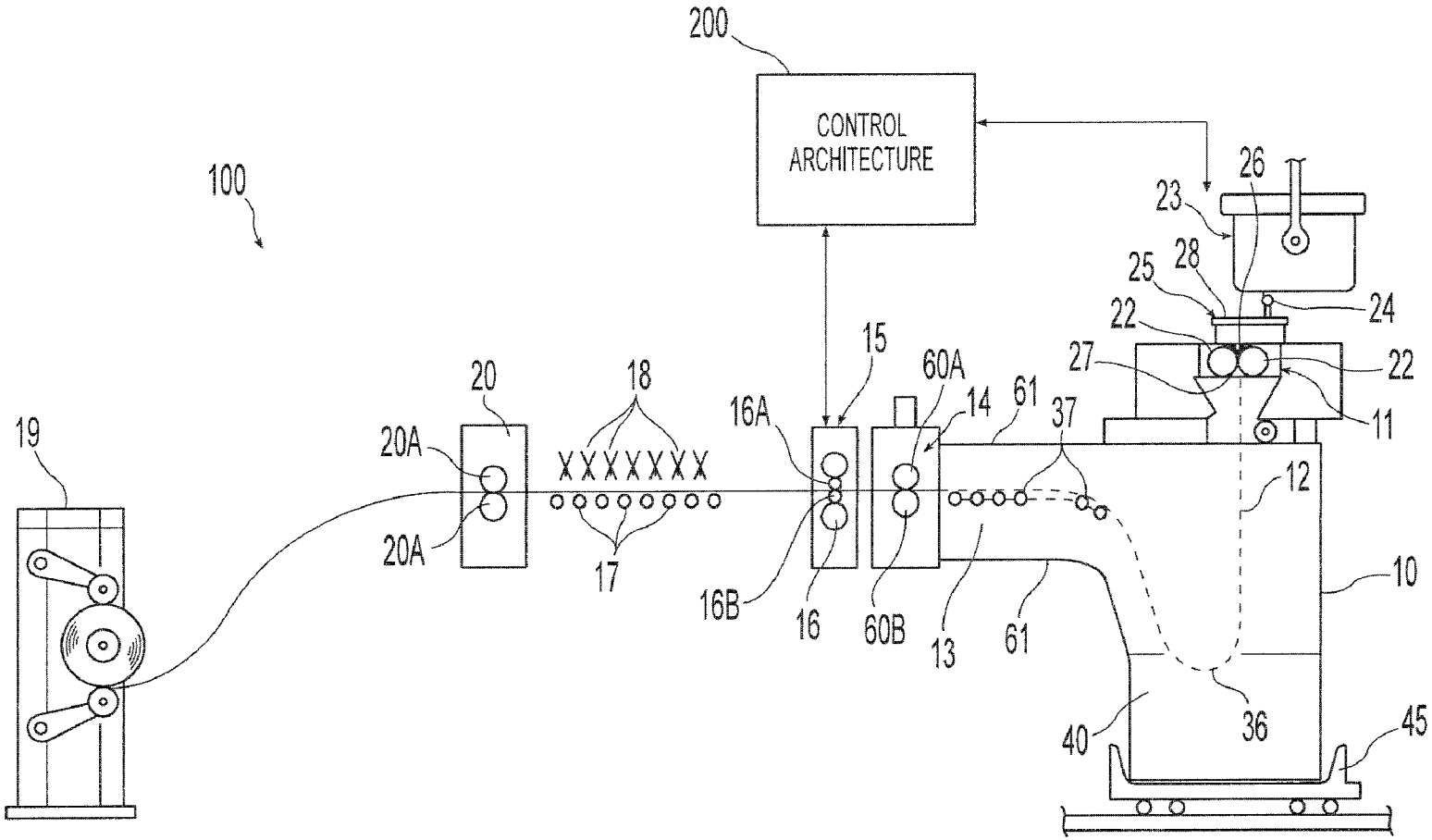
FIG. 1 is a schematic drawing illustrating a thin strip casting plant having a rolling mill and a control architecture.

FIG. 1 is a schematic drawing illustrating a thin strip casting plant 100 having a rolling mill 15 and a control architecture 200. The illustrated casting and rolling installation comprises a twin-roll caster, denoted generally by 11, which produces thin cast steel strip 12 and comprises casting rolls 22 and side dams 26. During operation, the casting rolls are counter-rotated by a drive (not shown). A metal delivery system comprising at least a ladle or moveable tundish 23, a second movable tundish 25, and a core nozzle 24 provides molten steel to the twin roll caster 11. Thin cast steel strip 12 passes downwardly through a nip 27 between the casting rolls 22 and then into a transient path across a guide table 13 to a pinch roll stand 14. After exiting the pinch roll stand 14, thin cast strip 12 passes into and through hot rolling mill 15 comprised of back up rolls 16 and upper and lower work rolls 16A and 16B, where the geometry (e.g., thickness, profile, and/or flatness) of the strip may be modified in a controlled manner. The strip 12, upon exiting the rolling mill 15, passes onto a run out table 17, where it may be forced cooled by water jets 18, and then through pinch roll stand 20, comprising a pair of pinch rolls 20A and 20B, and then to a coiler 19, where the strip 12 is coiled, for example, into 20 ton coils. The control architecture 200 interfaces to the rolling mill 15 and, optionally, to a caster feedback controller 301 (see FIG. 3) to control the geometry (e.g., thickness, profile, and/or flatness) of the steel strip 12.

In the present invention, a synthesized feedback signal (differential strain feed-back) is generated, as described herein, for better control of strip flatness and profile in the rolling mill of a continuous twin roll casting system. Additionally, flatness defects may be distinguished from other general vibration and body translational motions of the strip. If not distinguished, false positives can result that would typically indicate an asymmetric defect in the strip and could introduce differential bending control and coolant control problems. The synthesized feedback signal is useful in controlling small flatness defects before they are visible to the human eye. When using only flatness measurements detecting visible, or manifest, defects for the feedback control, some buckle defects may develop at the mill roll entry and exit of sufficient magnitude to risk pinching and tearing of the strip, without any manifest detectable flatness problems at the downstream gauge location.

Figure 2:
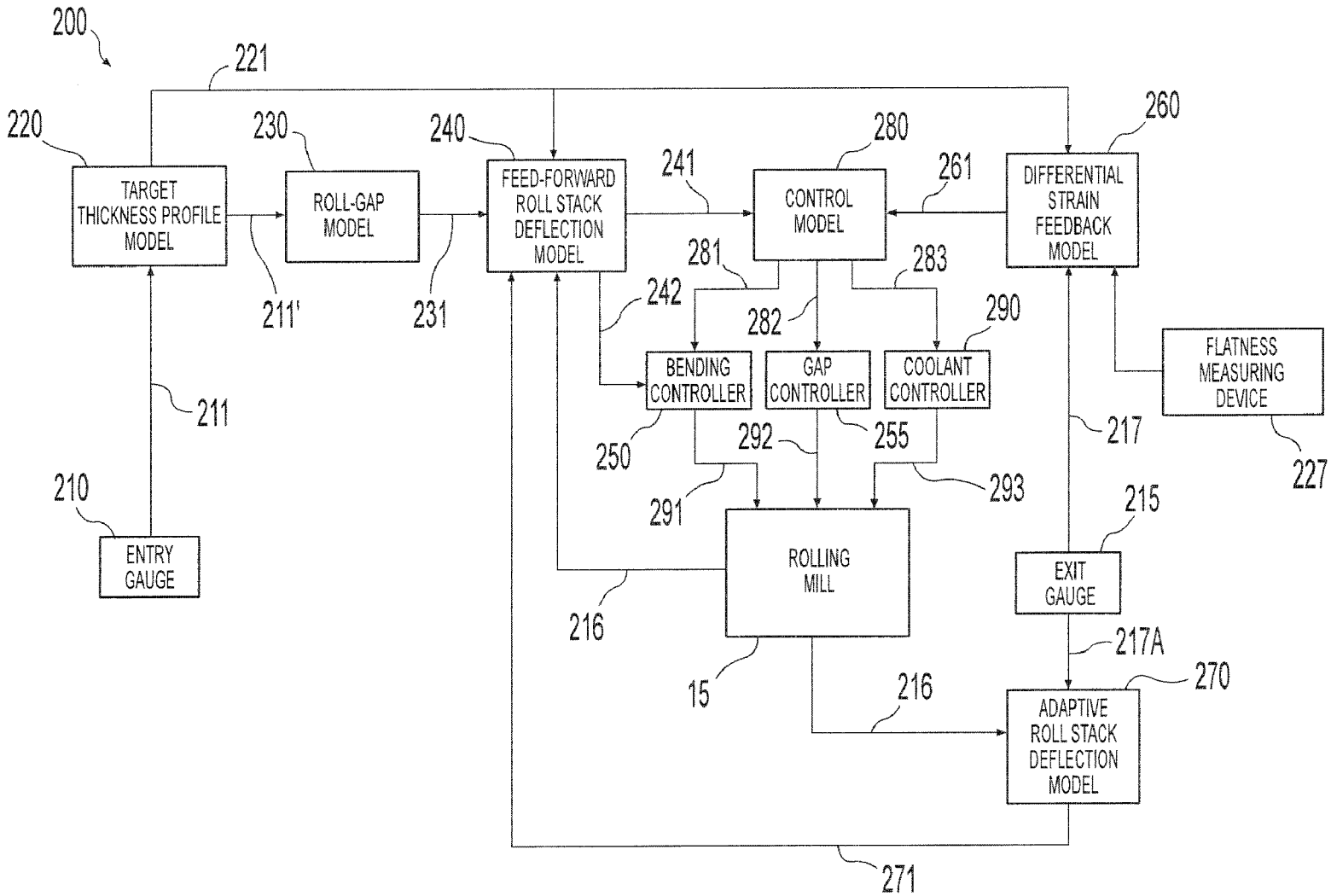
FIG. 2 is a block diagram of the control architecture of FIG. 1 interfacing to the rolling mill of FIG. 1.

FIG. 2 is a block diagram of the control architecture 200 of FIG. 1 interfacing to the rolling mill 15 of FIG. 1. The control architecture 200 provides accurate strip thickness profile measurements at the entry and exit of the rolling mill 15 in conjunction with exit flatness measurements and other instrumentation to form an integrated feed-forward and feed-back profile, strain, and flatness control scheme.

The control architecture 200 includes an entry gauge apparatus 210 capable of measuring an entry thickness profile 211 of the incoming metal strip 12 before the metal strip 12 enters the rolling mill 15. The entry gauge apparatus 210 may comprise an X-ray, laser, infrared, or other device capable of measuring an entry thickness profile of the incoming metal strip 12. The entry measurements 211 from the entry gauge apparatus 210 are forwarded to a target thickness profile model 220 of the control architecture 200.

The target thickness profile model 220 is capable of calculating a target thickness profile 221 as a function of the measured entry thickness profile 211. The target thickness profile 221 may further be a function of desired profile and flatness parameters. The target thickness profile 221 may include desired flatness parameters such that the change in geometry 211' required to achieve the target thickness profile 221 is insufficient to produce strip buckling (described in detail below). The target thickness profile 221 may include desired profile parameters such as a desired profile or reduction of the entry thickness profile. The target thickness profile 221 may differ from desired profile parameters when the change in geometry required to achieve the desired profile causes flatness to exceed desired flatness parameters, such as producing slight or manifest local strip buckling. The target thickness profile 221 satisfies strip profile and flatness operating requirements.

We have found that calculating the target thickness profile 221 to maintain a desired thickness profile may cause flatness errors to increase, and conversely, calculating the target thickness profile 221 to maintain a desired flatness may cause thickness profile errors to increase. The target thickness profile model 220 may include balancing the target thickness profile 221 to provide an improved thickness profile with controlled or reduced flatness errors. Alternately, the target thickness profile 221 may be calculated to improve the thickness profile without controlling flatness, with an allowable flatness error range later corrected on a leveling or flattening coil processing line. Alternately or in addition, the target thickness profile 221 may be determined as a function of a change in geometry of the metal strip to achieve desired profile parameters without producing local strip buckling.

The target thickness profile model 220 may comprise a mathematical model implemented in software on a processor-based platform (e.g., a PC). Alternatively, the target thickness profile model 220 may comprise a mathematical model implemented in firmware in an application specific integrated circuit (ASIC), for example. The target thickness profile model 220 may also be implemented in other ways as known to those skilled in the art. Similarly, other models described herein are mathematical models which may be implemented in various ways.

The target thickness profile model 220 also operationally interfaces to a roll-gap model 230 of the control architecture 200. The change in geometry 211' necessary to maintain the target thickness profile 221 given the current entry thickness profile 211 is forwarded to the roll gap model 230 from the target thickness profile model 220. The roll-gap model 230 is capable of generating a roll gap pressure profile 231 as a function of at least the change in entry geometry 211', corresponding to the roll gap pressure between the work rolls 16A and 16B of the rolling mill 15. The roll-gap model 230 may also use the physical dimensions and characteristics of the rolling mill equipment along with measurements of the roll force disturbances 216, tensions, and entry thickness profile 211, to generate the roll gap pressure profile required to achieve the target thickness profile.

The target thickness profile model 220 and the roll-gap model 230 also operationally interface to a feed-forward roll stack deflection model 240. The feed-forward roll stack deflection model provides feed-forward flatness control and feed-forward profile control. The feed-forward roll stack deflection model may provide feed-forward flatness control and feed-forward profile control using control sensitivity vectors and control references. The feed-forward roll stack deflection model 240 may be capable of generating actuator profile and flatness control sensitivity vectors 241 and feed-forward control references 242 as a function of at least the target thickness profile 221 and the roll gap pressure profile 231. The actuator profile and flatness control sensitivity vectors 241 and feed-forward control references 242 are used to control a bending controller 250 and a roll gap controller 255 (or some other suitable device that influences the loaded work roll gap of the rolling mill 15) in response to disturbances in the strip entry thickness profile 211 and roll force disturbances 216 within the rolling mill 15. The actuator profile and flatness control sensitivity vectors 241 and feed-forward control references 242 may also be used to control a coolant controller 290 capable of controlling coolant to the work roll to influence the shape of the working rolls 16A and/or 16B. Bending by the working rolls 16A and/or 16B is controlled by the bending controller 250. A roll gap between the working rolls 16A and 16B is controlled by the roll gap controller 255.

Figure 6:
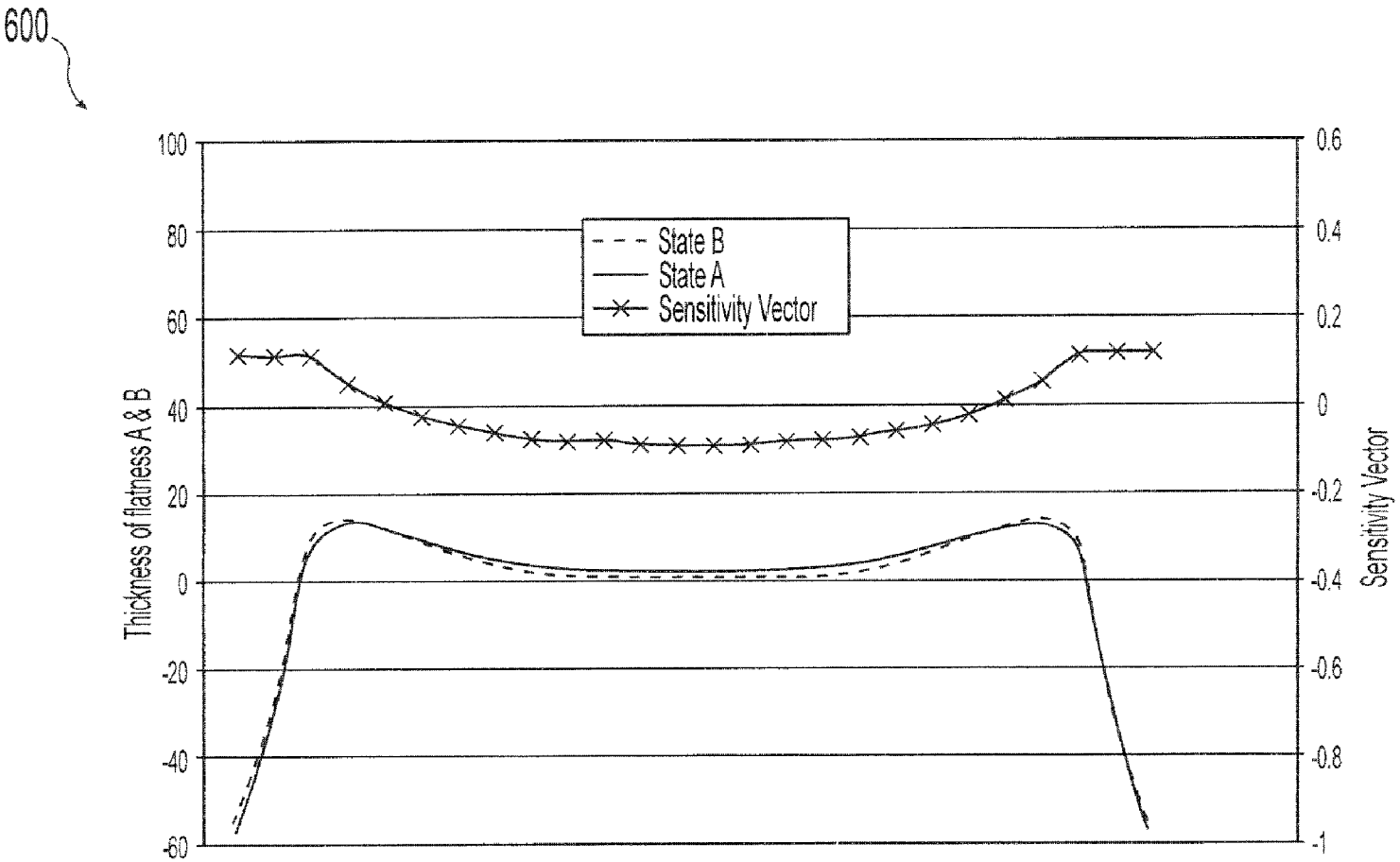
FIG. 6 is a graph illustrating how a sensitivity vector is obtained.

A sensitivity vector represents the predicted effect upon the transverse strip thickness profile or strip flatness that is created by a change in an actuator setting. For example, changing the bending while the mill is in a particular operating state will cause the strip profile or flatness to change from an original state A to another state B as shown in the graph 600 of FIG. 6. The sensitivity vector is that vector obtained by differencing state A and state B and dividing the result by the change in actuator setting which was responsible for the change from state A to state B. The sensitivity vectors may be adjusted using measurements of the strip taken after exiting the rolling mill to improve their accuracy.

A feed-forward control reference is a reference for a control actuator, such as an actuator associated with the bending controller or the gap controller, required to achieve some control objective for a particular section of strip, such as improved flatness or profile. The feed-forward control references 242 are calculated based upon information that is available before that particular section of strip enters the rolling mill, including the entry thickness profile 211, and the profile and flatness control sensitivity vectors 241. The most common form would be the calculation of an improved bending setting, based upon the measured entry thickness profile 211, i.e. measured prior to entering the mill, given the current roll force and roll stack geometry (roll sizes, widths etc). Such a calculation is facilitated by means of the mathematical model herein known as the roll stack deflection model 240.

The control architecture 200 also includes an exit gauge apparatus 215 capable of measuring exit features 217 of the metal strip 12 after the metal strip 12 exits the rolling mill 15. The exit gauge apparatus 215 may comprise an X-ray, laser, infrared, or other device capable of measuring an exit thickness profile 217A and/or other features of the exiting metal strip 12 (e.g., strip temperature and strip flatness). In addition, a flatness measuring device 227 may be provided capable of measuring the flatness 217C of the metal strip 12 after the metal strip 12 exits the rolling mill 15. The flatness measuring device 227 may be an optical flatness measurement device, a strip tension measurement device, a laser flatness measurement device, or any other device or method capable of measuring the manifest flatness of the strip.

The measurements from the exit gauge apparatus 215, and optionally the flatness measuring device 227, are forwarded to a differential strain feedback model 260 of the control architecture 200 which operationally interfaces to the exit gauge apparatus 215. The differential strain feedback model 260 also operationally interfaces to the target thickness profile model 220 and is capable of calculating a differential strain feed-back 261 as a function of at least the calculated target thickness profile 221, the measured exit thickness profile 217A, and a target strain profile 360 (see FIG. 3) which is discussed in more detail below with respect to FIG. 3. Optionally, the differential strain feed-back 261 is also a function of the strip flatness 217C, and may further compensate for strip temperature 217B.

The measurements 217 from the exit gauge apparatus 215 are also forwarded to an adaptive roll stack deflection model 270 of the control architecture 200 capable of generating an adaptive roll gap error vector 271 in response to at least the exit thickness profile 217A to cause adaptation of the feed-forward roll stack deflection model 240. The adaptive roll stack deflection model 270 also receives a roll force parameter 216 from the rolling mill 15 which may be used in generating the adaptive roll gap error vector 271. The adaptive roll gap error vector 271 may indicate how certain operation of the bending controller 250, the gap controller 255, and the coolant controller 290 affect the strip profile. The feed-forward roll stack deflection model 240 may then use the adaptive roll gap error vector 271 in generating the actuator profile and flatness control sensitivity vectors 241.

The control architecture 200 also may include a control model 280 operationally interfacing to the feed-forward roll stack deflection model 240 and the differential strain feed-back model 260. The control model 280 is capable of generating control signals 281-283 for controlling at least one of the bending controller 250, the gap controller 255, the coolant controller 290, and other suitable devices that influence a form of the loaded work roll gap of the rolling mill 15, in response to at least the differential strain feed-back 261 and actuator profile and flatness control sensitivity vectors 241. The coolant controller 290 provides coolant to the work rolls 16A and 16B in a controlled manner. The bending controller 250, gap controller 255, and coolant controller 290 each provide respective mill actuator parameters 291-293 to the rolling mill 15 for manipulating the various aspects of the rolling mill 15 as described above herein to adapt the shape of the metal strip 12.

Figure 3A:
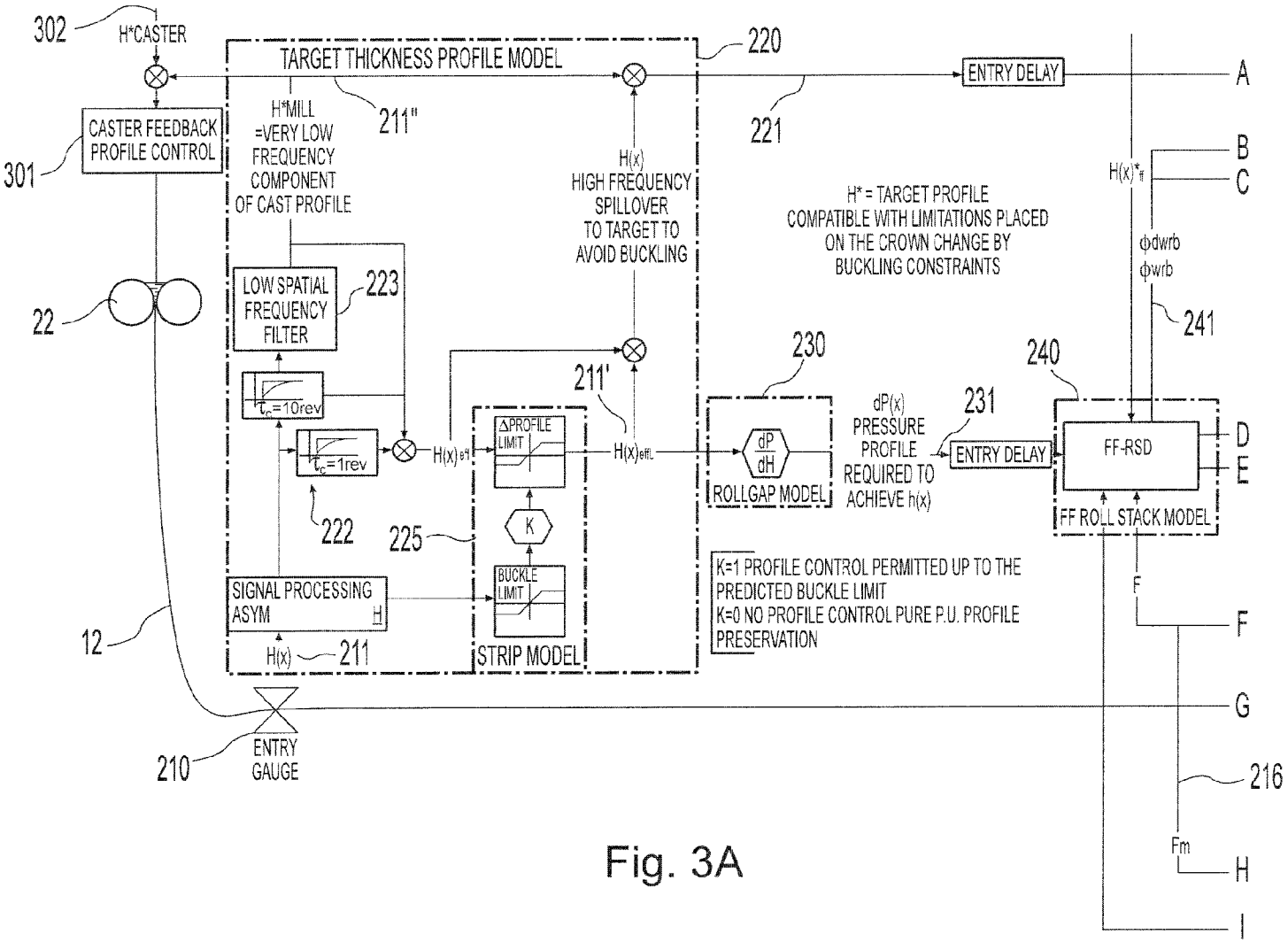
FIG. 3 is a more detailed block diagram of the control architecture of FIG. 1.
Figure 3B:
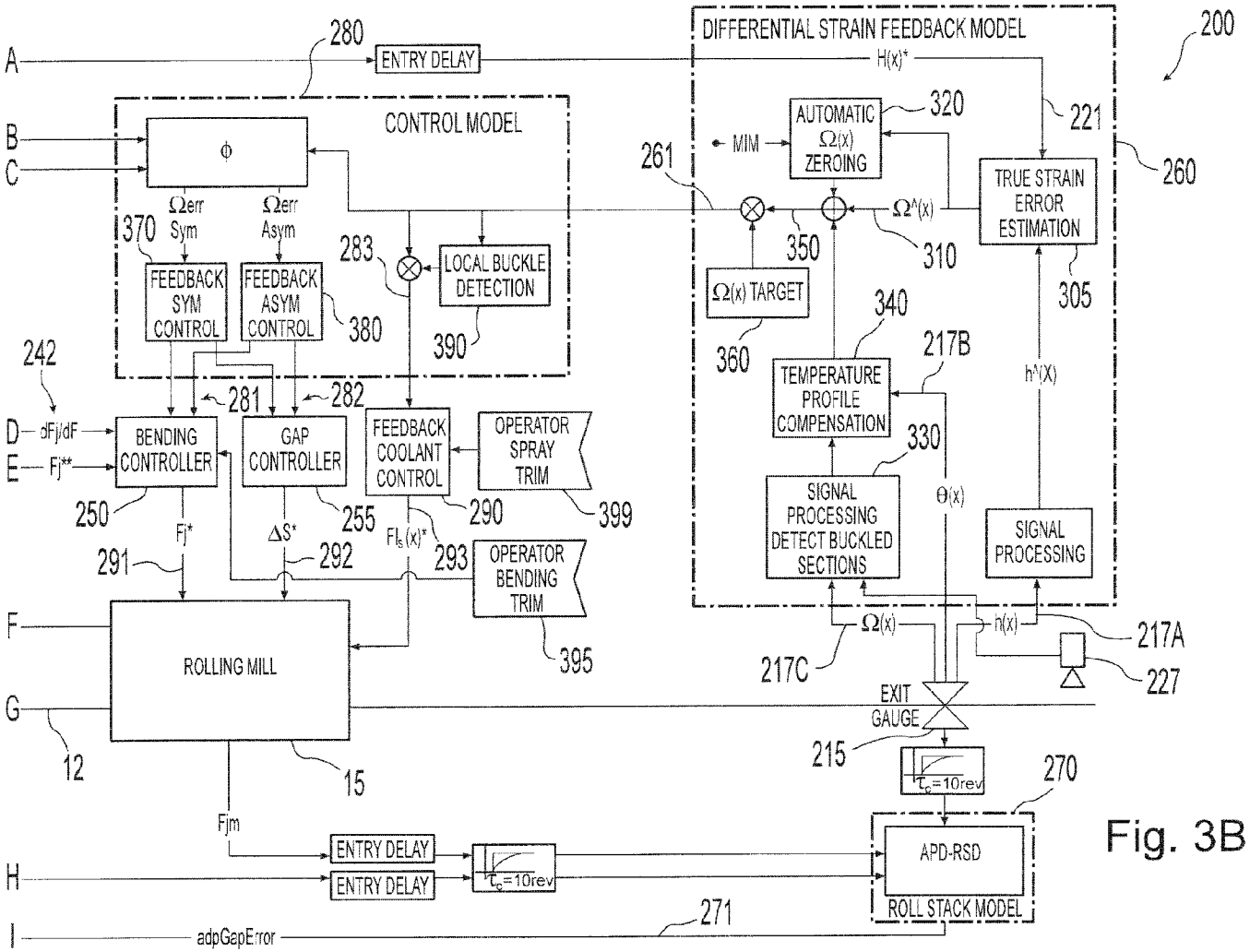

FIG. 3 is a more detailed block diagram of the control architecture 200 of FIG. 1 and FIG. 2, interfacing to the rolling mill 15 of FIG. 1 and FIG. 2. FIG. 3 also shows the metal strip 12 exiting the casting rolls 22, passing by the entry gauge 210, entering the rolling mill 15, exiting the rolling mill 15 and passing by the exit gauge 215. As an option, the control architecture 200 includes a caster feedback geometry control 301 which uses a processed version 211" of the measured entry thickness profile 211 to adapt the operation of the casting rolls 22. Such a caster feedback geometry control 301 may be used to adjust the casting rolls 22 to control the entry thickness profile 211 of the metal strip 12 to a desired nominal cast target strip profile 302.

The target thickness profile 221 may be a target per unit thickness profile, and may be based upon a substantial improvement in thickness profile given the incoming entry thickness profile 211, without producing unacceptable buckles in the strip 12. Such a target thickness profile 221 is used instead of only the actual entry thickness profile 211 in the comparison with the exit thickness profile to produce the feedback error (differential strain feed-back), as is described below herein. Therefore, the rolling mill controllers are forced to drive the exit thickness profile to match the target thickness profile, which may respect limit constraints set by the buckling characteristics of the strip. In this embodiment, any condition that does not exceed the buckling limit constraints will produce a control response yielding profile and flatness improvements.

The measured entry thickness profile 211 is an input to the target thickness profile model 220 and is processed by performing time filtering and spatial frequency filtering using time filtering capability 222 and spatial frequency filtering capability 223 within the model 220. The target thickness profile model 220 may include a strip model 225 that serves to incorporate buckle limit constraints and/or profile change limit constraints into the target thickness profile 221 being generated by the model 220. Such limits keep the geometry change of the metal strip 12 from approaching parameters that can cause the metal strip 12 to buckle during processing through the thin strip casting plant 100. That is, the target thickness profile 221 incorporates improvements for the incoming entry thickness profile 211 compatible with strip buckling limits. As a result, in the presence of undesirable geometries from the caster, the target thickness profile 221 will include such variation in the cast geometry that cannot be removed without exceeding the buckle limits.

In accordance with an embodiment of the present invention, the target thickness profile model 220 implements the following mathematical algorithm:

H(X)*=H^mill(x)+dHhfspill(x); H(x)* is the target thickness profile 221, where H^mill(x)=LSFF(LPF(H(x))); H^mill(x) is the low spatial and time frequency filtered incoming strip thickness profile 211", and LSFF( ) is the low spatial frequency filter 223 by least squares best fit of low order polynomials, LFP( ) is the Low Pass Filter 222 with a time constant set around 1-10 casting roll revolutions, and H(x) is the Entry Thickness Profile 211; and where dHhfspill(x)=sHerror(x)−dHerrorLimited(x); dHhfspill (x) is the high frequency spillover to target to avoid local strip buckling, dHerrorLimited(x)=minimum (dHerror(x), Limit_dh(x)); dHerrorLimited(x) is the local geometry change after buckle limiting 225, and Limit_dh(x) is evaluated from Limit_dh(x)=H*(K*Cs*(H/Wc(x))2+correction for average total strain and applied tension, giving maximum local geometry change to avoid buckling, where H=average entry thickness, Wc(x)=local compressive region width, Cs=pi2*E/(12(1-mu**2)) elastic constant, and K=constraint scale factor.

Therefore, the target thickness profile model 220 is a function of entry geometry, strip tension, total rolling strain, and selection of time and spatial filtering constants. The resultant target thickness profile 221 is forwarded to the feed-forward roll stack deflection model 240 and the differential strain feedback model 260.

As discussed above, the target thickness profile model 220 may be used to calculate the target thickness profile 221 to improve the thickness profile without controlling flatness within the allowable flatness error range. In this embodiment, the differential strain feed back model 260 may be capable of receiving the allowable flatness error range, and the differential strain feed back model calculating a differential strain feed back 261 improving the exit thickness profile without controlling flatness within the allowable flatness error range. The target thickness profile 221 may become a function of the strip flatness measurement 217C when the strip flatness measurement is outside of the allowable flatness error range. The allowable flatness error range may be selected to allow minor surface defects that may be corrected in a subsequent coil processing operation, such as a tension leveling or roller leveling operation.

The roll gap model 230 also receives a processed version 211' representing the change in thickness profile necessary to achieve the target thickness profile given the current entry thickness profile. The strip model 225 and the roll gap model 230 account for creep, buckling, and related geometry and stress changes that may occur outside of the roll gap, and for pressure changes that may occur inside the roll gap of the rolling mill 15.

Alternately, the entry gauge 210 of the control architecture 200 may not be present, or inhibited such that the resultant target thickness profile 221 is based on estimated entry thickness profile information instead of actual measured entry thickness profile information 211. Therefore, the target thickness profile 221 is independent of the actual entry thickness profile 211 in such alternative embodiments.

The feed-forward roll stack deflection model 240 may be a complete finite difference roll stack deflection model or alternatively, a simplified model that predicts the required profile actuator settings to improve the loaded roll gap form to match the desired strip thickness profile. Inputs to the model include the geometry of the rolling mill 15, the incoming strip geometry, the roll gap pressure profile 231 between the strip and the rolls, the desired or current rolling force 216 and optionally, the adaptive roll gap error 271. Outputs of the model are the optimized actuator control references 242 for feed-forward control and the actuator profile and flatness sensitivity vectors 241 for use in the feedback control scheme.

The differential strain feedback model 260 accepts measurements of exit thickness profile 217A, strip temperature 217B, and strip flatness 217C from the exit gauge 215 and flatness measuring device 227. The strip flatness measurements 217C from the exit gauge apparatus 215 and/or flatness measuring device 227 are passed through a signal processing stage 330 within the differential strain feedback model 260 to remove body motion components from the measurements. Therefore, measurements caused by the strip rotation, strip bouncing, or strip vibration about a longitudinal axis may be removed. Such signal processing reduces the false positives of non-flatness. The exit thickness profile 217A is also filtered, and is compared to the target thickness profile 221 in the strain error estimator 305. The strain error estimator 305 may utilize a difference between the exit thickness profile 217A and the target thickness profile 221 to form an initial estimate of a rolling strain profile 310. The rolling strain profile 310 may be used to approximate the flatness of the strip.

The raw estimate of rolling strain profile 310 is further processed using automatic nulling capability 320 by subtracting out systematic measurement errors from the rolling strain profile 310 when the rolling mill 15 is engaged. The systematic measurement errors are generated through comparison of the entry and exit thickness profiles when the rolling mill is disengaged. Ideally, no systematic measurement errors are present in the strip casting plant 100, and the measurement entry and exit thickness profiles will be the same when strip casting plant 100 is operating without the rolling mill being engaged. However, this is seldom, if ever, likely. Therefore, the systematic measurement errors are nulled out (taken out of the estimate of rolling strain profile 310).

Additionally, other exit gauge information, such as the strip flatness measurement 217C, may be incorporated into the estimate of rolling strain profile to produce a synthesized feedback signal. Further signal processing 330 may be performed on the strip flatness measurement 217C to detect buckled sections, and temperature profile compensation 340 (compensating for the effect of transverse temperature profile) may be provided based on strip temperature 217B measurements, and the results incorporated into the estimate of rolling strain profile 310. The resulting full width rolling strain profile 350 is robust to any time based variation in the difference between the profile measurement characteristics that may occur during rolling. The rolling strain profile 350 is compared to a desired target strain profile 360 to form the differential strain feed-back 261 (error) which is fed back to the control model 280.

The differential strain feed-back 261 from the differential strain feedback model 260 is used by the control model 280, along with the actuator profile and flatness control sensitivity vectors 241 to generate a set of control signals 281-283 to the bending controller 250, the roll gap controller 255, and the feedback coolant controller 290. The flatness control sensitivity vectors 241 are used to perform the mathematical dot product operation with the differential strain feed-back 261, the result of which are the scalar actuator errors for the various actuators used in the control scheme. When the flatness control sensitivity vectors 241 are not available from online calculation, then they may be provided from a non real-time source such as offline calculation or manual approximation arrived at via experimental observation. Irrespective of the source of the flatness control sensitivity vectors, the resulting scalar actuator errors are in turn used by the feedback controllers 370 and 380 to perform their function. Within the control model 280, symmetric feedback control capability 370 and asymmetric feed-back control capability 380 are performed to generate the control signals 281 and 282 to the bending controller 250 and the roll gap controller 255.

The potential of a particular region of the strip to buckle is related to the stress and strain conditions in a local area of the strip, rather than to the average state of the strip. Therefore, local buckle detection 390 is also performed within the control model 280 to generate the control signal 283 to the feedback coolant control 290. The control signals 281-283 and the feed-forward control references 242 allow various aspects of the rolling mill 15 to be automatically controlled in order to achieve a desired strip geometry (e.g., profile and flatness) of the metal strip out of the rolling mill 15 without experiencing problems such as strip buckling.

In addition, the bending controller 250 may be further manually adapted by an operator-induced bending trim capability 395, and the coolant controller 290 may be further manually adapted by an operator-induced spray trim capability 399 supported by the control architecture 200. In general, feedback control using segmented spray headers, roll bending, roll tilting, and other roll crown manipulation actuators, as available, may be accomplished to minimize the error in the observed rolling strain profile.

The bending controller 250, gap controller 255, and coolant controller 290 provide mill actuator parameters 291-293 to the rolling mill in response to the control signals 281-283, feed-forward control references 242, and operator trim inputs to achieve the desired strip geometry result. The bending controller 250 controls roll bending of the work rolls 16A and 16B of the rolling mill 15. The gap controller 255 controls a roll gap between the work rolls 16A and 16B. The coolant controller 290 controls the amount of coolant provided to the work rolls 16A and 16B.

Such continuous twin roll casting allows the plant 100 with the features described to respond to the major process disturbances and produce a strip with a substantially improved exit thickness profile given the current strip casting conditions, while avoiding buckling of strip at the entry or exit of the roll bite of the hot mill. The use of the incoming thickness profile information and the correct use of the difference between the incoming and outgoing thickness profile information represent a significant step forward for the technology of profile and flatness control.

Figure 4:
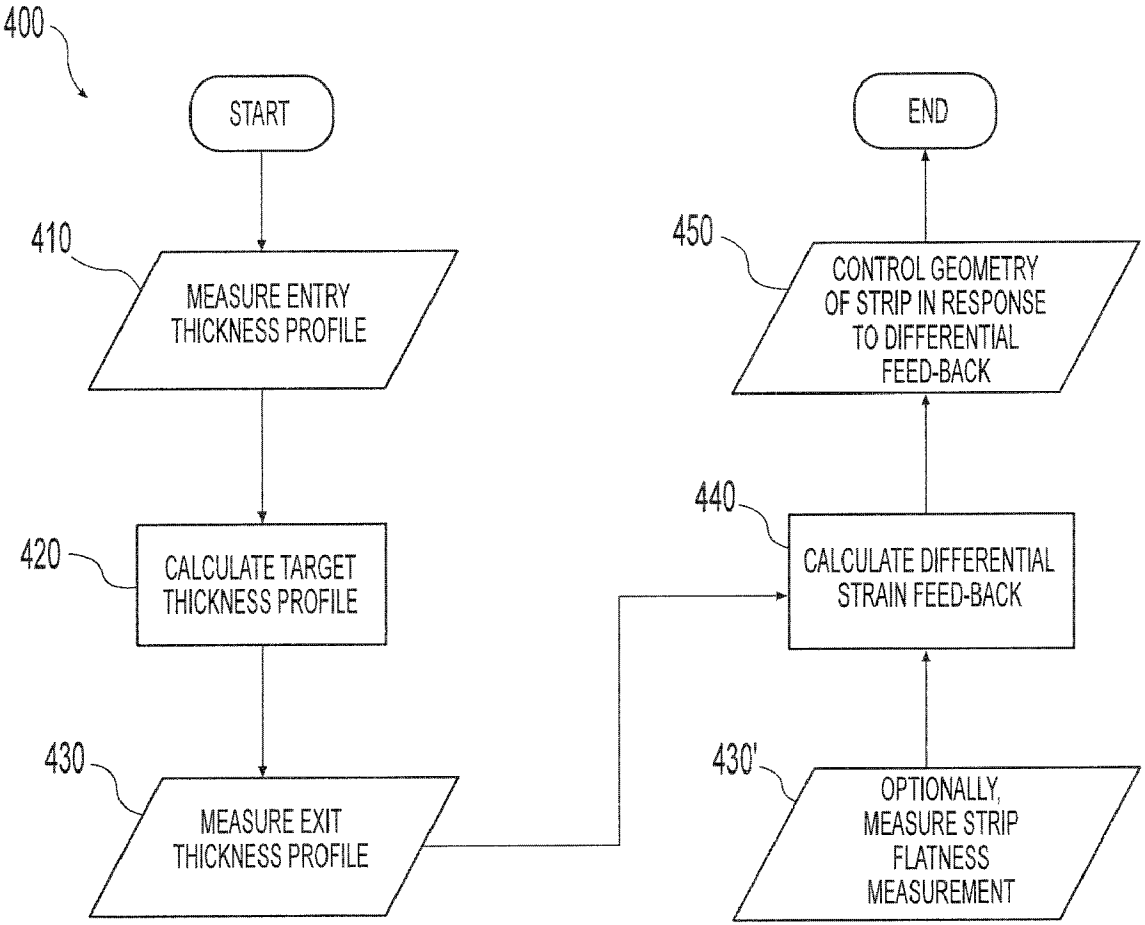
FIG. 4 is a flowchart of an embodiment of a method of controlling strip geometry in casting strip having a hot rolling mill.

FIG. 4 is a flowchart of an embodiment of a method 400 of controlling strip geometry in casting strip having a hot rolling mill 15. In step 410, an entry thickness profile 211 of an incoming metal strip 12 is measured before the metal strip 12 enters the hot rolling mill 15. In step 420, a target thickness profile 221 is calculated. The target thickness profile 221 may be a function of the measured entry thickness profile 211 while satisfying desired profile and flatness parameters. In step 430, an exit thickness profile 217A of the metal strip 12, and optionally, strip flatness measurement 217C is measured after the metal strip 12 exits the hot rolling mill 15. In step 440, a differential strain feedback 261 is calculated from longitudinal strain in the strip by comparing the exit thickness profile 217A with the target thickness profile 221 derived from the measured entry thickness profile. In step 450, a device capable of affecting the geometry of the strip 12 exiting the hot rolling mill 15 is controlled in response to the differential strain feedback 261, state of the rolling mill 15, and incoming thickness profile 211.

In the method 400 of controlling strip geometry in casting strip having a hot rolling mill 15, the device capable of affecting the geometry of the strip exiting the hot rolling mill may be any or all of a bending controller 250, a gap controller 255, and a coolant controller 293.

The method 400 further may include calculating a roll gap pressure profile 231 from the entry thickness profile 211 and dimensions and characteristics of the hot rolling mill, and calculating a feed-forward control reference 242 and/or a sensitivity vector 241 as a function of the target thickness profile 221 and the roll gap pressure profile 231 to allow compensation for profile and flatness fluctuations in the cast strip 12. The device capable of affecting the geometry of the strip exiting the hot rolling mill 15 may be further controlled in response to the calculated feed-forward control reference 242 and/or the calculated sensitivity vector 241. Furthermore, an adaptive roll gap error vector 271 may be generated from the measured exit thickness profile and used in calculating at least one of the feed-forward control reference 242 and the sensitivity vector 241.

Figure 5:
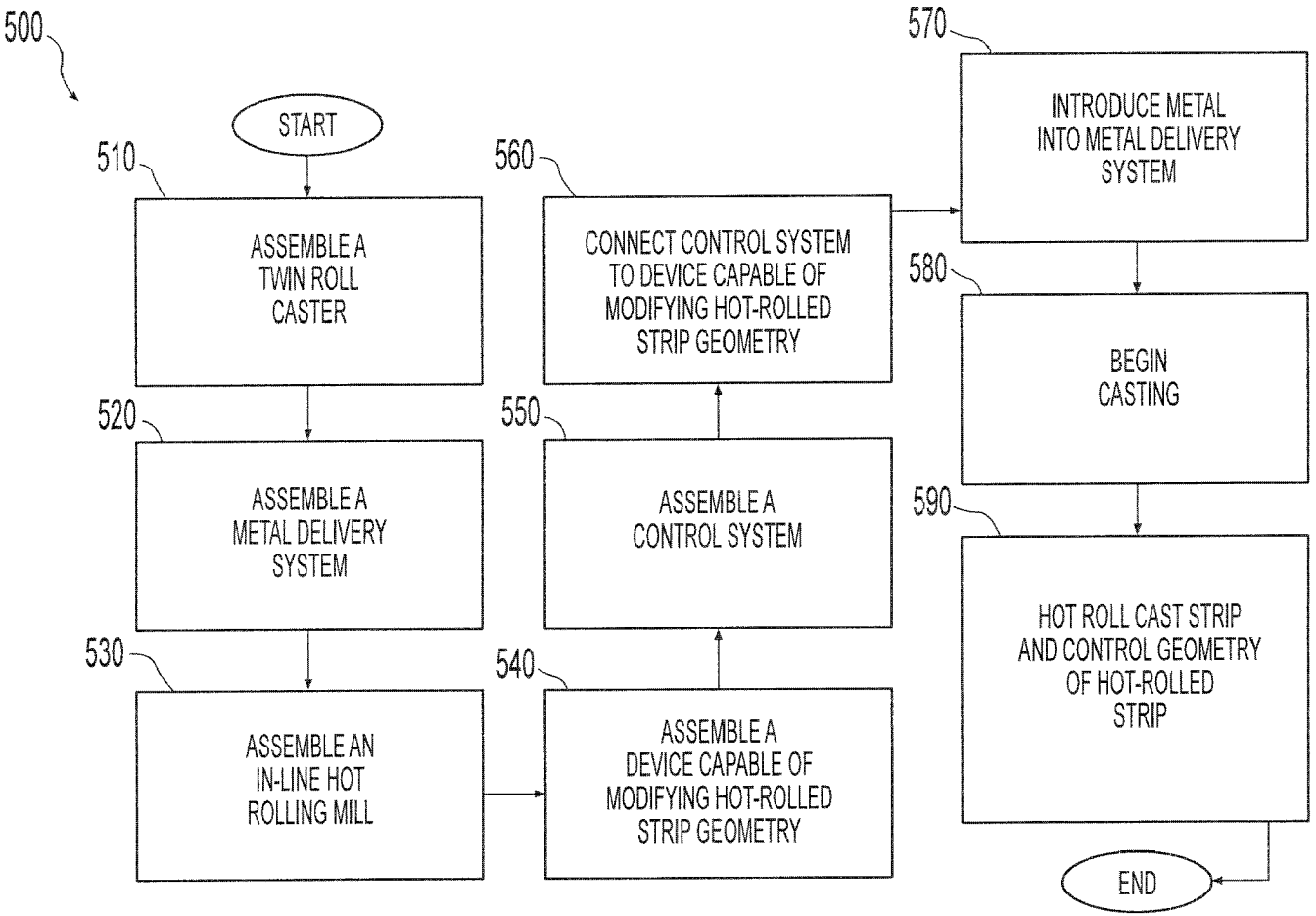
FIG. 5 is a flowchart of a method of producing thin cast strip with a controlled strip geometry by continuous casting.

FIG. 5 is a flowchart of a method 500 of producing thin cast strip with a controlled strip geometry by continuous casting. In step 510, a thin strip caster having a pair of casting rolls is assembled having a nip therebetween. In step 520, a metal delivery system is assembled capable of forming a casting pool between the casting rolls above the nip with side dams adjacent the ends of the nip to confine the casting pool. In step 530, a hot rolling mill is assembled having work rolls with work surfaces forming a roll gap between them through which incoming hot strip from the thin strip caster is rolled, the work rolls having work roll surfaces relating to a desired shape across the work rolls. In step 540, a device is assembled capable of affecting the geometry of the strip exiting the hot rolling mill in response to control signals. In step 550, a control system is assembled capable of generating a differential strain feed-back, and capable of generating the control signals in response to the differential strain feed-back, state of the mill, and incoming thickness profile. In step 560, the control system is operationally connected to the device capable of affecting the geometry of the strip exiting the hot rolling mill. In step 570, molten steel is introduced between the pair of casting rolls to form a casting pool supported on casting surfaces of the casting rolls confined by the side dams. In step 580, the casting rolls are counter-rotated to form solidified metal shells on the surfaces of the casting rolls and cast thin steel strip through the nip between the casting rolls from the solidified shells. In step 590, the incoming thin cast strip is rolled between the work rolls of the hot rolling mill and varying at least one of the roll gap of the work rolls, bending by the work rolls, and a coolant provided to the work rolls in response to at least one of the control signals, to affect the geometry of the hot strip exiting the hot rolling mill.

In the method 500, the device capable of affecting the geometry of the strip exiting the hot rolling mill 15 may be one or more of a bending controller 250, a gap controller 255, and a coolant controller 290. The control system is further capable of generating a feed-forward control reference 242 and a sensitivity vector 241, and further capable of generating the control signals 281-283 in response to the differential strain feedback 261, the feed-forward control reference 242, and the sensitivity vector 241. The differential strain feedback 261 is calculated from longitudinal strain in the strip 12 by comparing a measured exit thickness profile 217A with a calculated target thickness profile 221 derived from a measured entry thickness profile 211, and optionally, the strip flatness measurement 217C. The feed-forward control reference 242 and the sensitivity vector 241 are calculated as a function of the target thickness profile 221, derived from a measured entry thickness profile 211, and a roll gap pressure profile 231 to allow compensation for profile and flatness fluctuations in the cast strip 12.

The bending controller 250, gap controller 255, coolant controller 290, and other suitable device that influences the loaded work roll gap may be considered to be part of the control architecture 200. Alternatively, the bending controller 250, gap controller 255, coolant controller 290, and other suitable device that may influence the loaded work roll gap may be considered to be part of the rolling mill 15. Similarly, in accordance with certain embodiments of the present invention, various aspects of the control architecture 200 may be considered a part of one model or another model of the control architecture 200. For example, the bending controller 250, gap controller 255, and coolant controller 290 may be considered to be part of the control model 280 of the control architecture 200.

In summary, a method and apparatus of controlling strip geometry in a continuous twin roll caster system having a hot rolling mill is disclosed, with a control architecture using both feed-forward and feed-back to control the geometry of the cast strip exiting the hot rolling mill while preventing buckling of the cast strip. While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A method of controlling strip geometry in casting strip having a hot rolling mill comprising:
   - measuring an entry thickness profile of an incoming metal strip before the metal strip enters the hot rolling mill;
   - calculating a target thickness profile as a function of the measured entry thickness profile while satisfying desired profile and flatness parameters;
   - measuring an exit thickness profile of the metal strip after the metal strip exits the hot rolling mill;
   - calculating a differential strain feed back from longitudinal strain in the strip by comparing the exit thickness profile with the target thickness profile; and
   - controlling a device capable of affecting the geometry of the strip exiting the hot rolling mill in response to at least the differential strain feed-back.

2. The method of controlling strip geometry in casting strip having a hot rolling mill of claim 1 where the device capable of affecting the geometry of the strip exiting the hot rolling mill is selected from one or more of the group consisting of a bending controller, a gap controller and a coolant controller.

3. The method of controlling strip geometry in casting strip having a hot rolling mill of claim 2 where the controlling step includes performing symmetric feed-back control and asymmetric feed-back control of the bending controller and the gap controller.

4. The method of controlling strip geometry in casting strip having a hot rolling mill of claim 1 further comprising:

calculating a roll gap pressure profile from the entry thickness profile and dimensions and characteristics of the hot rolling mill;

calculating one selected from a group consisting of a feed-forward control reference, a sensitivity vector, and a combination thereof as a function of the target thickness profile and the roll gap pressure profile to allow compensation for profile and flatness fluctuations in the cast strip; and further controlling the device capable of affecting the geometry of the strip exiting the hot rolling mill in response to said calculated feed-forward control reference, calculated sensitivity vector, or combination thereof.

5. The method of controlling strip geometry in casting strip having a hot rolling mill of claim 4 further comprising generating an adaptive roll gap error vector from the measured exit thickness profile and using the adaptive roll gap error vector in calculating at least one of the feed-forward control reference and the sensitivity vector.

6. The method of controlling strip geometry in casting strip having a hot rolling mill of claim 1 further comprising:

measuring a strip flatness measurement after the metal strip exits the hot rolling mill; and where calculating a differential strain feed back comprises incorporating the strip flatness measurement with a difference between the exit thickness profile and the target thickness profile.

7. The method of controlling strip geometry in casting strip having a hot rolling mill of claim 6 further comprising:

calculating a roll gap pressure profile from the entry thickness profile and dimensions and characteristics of the hot rolling mill;

calculating one selected from a group consisting of a feed-forward control reference, a sensitivity vector, and a combination thereof as a function of the target thickness profile and the roll gap pressure profile to allow compensation for profile and flatness fluctuations in the cast strip; and further controlling the device capable of affecting the geometry of the strip exiting the hot rolling mill in response to said calculated feed-forward control reference, calculated sensitivity vector, or combination thereof.

8. The method of controlling strip geometry in casting strip having a hot rolling mill of claim 1 further comprising:

determining an allowable flatness error range, and where calculating a differential strain feed back comprises improving the exit thickness profile without controlling flatness within the allowable flatness error range.

9. The method of controlling strip geometry in casting strip having a hot rolling mill of claim 8 further comprising:

calculating a roll gap pressure profile from the entry thickness profile and dimensions and characteristics of the hot rolling mill;

calculating one selected from a group consisting of a feed-forward control reference, a sensitivity vector, and a combination thereof as a function of the target thickness profile and the roll gap pressure profile to allow compensation for profile fluctuations in the cast strip; and further controlling the device capable of affecting the geometry of the strip exiting the hot rolling mill in response to said calculated feed-forward control reference, calculated sensitivity vector, or combination thereof.

10. The method of controlling strip geometry in casting strip having a hot rolling mill of claim 1 where calculating the target thickness profile includes performing at least one of time filtering and spatial frequency filtering.

11. The method of controlling strip geometry in casting strip having a hot rolling mill of claim 1 where the controlling step includes subtracting out systematic errors from the differential strain feed back when the rolling mill is engaged, the systematic errors being generated through comparison of the entry and exit thickness profiles when the rolling mill is disengaged.

12. The method of controlling strip geometry in casting strip having a hot rolling mill of claim 1 where the controlling step includes performing temperature compensation and buckle detection.

13. The method of controlling strip geometry in casting strip having a hot rolling mill of claim 1 where the controlling step includes performing at least one of operator-induced coolant trimming and operator-induced bending trimming.

14. The method of controlling strip geometry in casting strip having a hot rolling mill of claim 1 further comprising:

calculating the target thickness profile as a function of a change in geometry of the metal strip to achieve the target thickness profile without producing local strip buckling.

15. A control architecture for controlling strip geometry in casting strip having a hot rolling mill comprising:

an entry gauge apparatus capable of measuring an entry thickness profile of an incoming metal strip before the metal strip enters the rolling mill;

a target thickness profile model capable of calculating a target thickness profile as a function of the measured entry thickness profile while satisfying desired profile and flatness parameters;

an exit gauge apparatus capable of measuring an exit thickness profile of the metal strip after the metal strip exits the rolling mill;

a differential strain feed back model capable of calculating a differential strain feed-back from longitudinal strain in the strip by comparing the exit thickness profile with the target thickness profile; and a control model capable of controlling a device capable of affecting the geometry of the strip exiting the hot rolling mill in response to at least the differential strain feed back.

16. The control architecture for controlling strip geometry in casting strip having a hot rolling mill of claim 15 where the device capable of affecting the geometry of the strip exiting the hot rolling mill is selected from one or more of the group consisting of a bending controller, a gap controller, and a coolant controller.

17. The control architecture for controlling strip geometry in casting strip having a hot rolling mill of claim 16 where the control model includes a symmetric feed back capability and an asymmetric feed back capability for controlling the bending controller and the gap controller.

18. The control architecture for controlling strip geometry in casting strip having a hot rolling mill of claim 15 further comprising:

a roll-gap model capable of calculating a roll gap pressure profile from the entry thickness profile and dimensions and characteristics of the hot rolling mill; and a feed-forward roll stack deflection model capable of calculating one selected from a group consisting of a feed-forward control reference, a sensitivity vector, and a combination thereof as a function of the target thickness profile and the roll gap pressure profile to allow compensation for profile and flatness fluctuations in the cast strip.

19. The control architecture for controlling strip geometry in casting strip having a hot rolling mill of claim 18 further comprising an adaptive roll stack deflection model capable of generating an adaptive roll gap error vector from the measured exit thickness profile and using the adaptive roll gap error vector in calculating at least one of the feed-forward control reference and the sensitivity vector.

20. The control architecture for controlling strip geometry in casting strip having a hot rolling mill of claim 15 further comprising:

a flatness measuring device capable of measuring the flatness of the metal strip after the metal strip exits the rolling mill; and where the differential strain feed back model is capable of calculating the differential strain feed back comprising incorporating the strip flatness measurement with a difference between the exit thickness profile and the target thickness profile.

21. The control architecture for controlling strip geometry in casting strip having a hot rolling mill of claim 20 further comprising:

a roll-gap model capable of calculating a roll gap pressure profile from the entry thickness profile and dimensions and characteristics of the hot rolling mill; and a feed-forward roll stack deflection model capable of calculating one selected from a group consisting of a feed-forward control reference, a sensitivity vector, and a combination thereof as a function of the target thickness profile and the roll gap pressure profile to allow compensation for profile and flatness fluctuations in the cast strip.

22. The control architecture for controlling strip geometry in casting strip having a hot rolling mill of claim 15 where the differential strain feed back model is capable of receiving an allowable flatness error range, and the differential strain feed back model is capable of calculating a differential strain feed back improving the exit thickness profile without controlling flatness within the allowable flatness error range.

23. The control architecture for controlling strip geometry in casting strip having a hot rolling mill of claim 22 further comprising:

a roll-gap model capable of calculating a roll gap pressure profile from the entry thickness profile and dimensions and characteristics of the hot rolling mill; and a feed-forward roll stack deflection model capable of calculating one selected from a group consisting of a feed-forward control reference, a sensitivity vector, and a combination thereof as a function of the target thickness profile and the roll gap pressure profile to allow compensation for profile fluctuations in the cast strip.

24. The control architecture for controlling strip geometry in casting strip having a hot rolling mill of claim 15 where the target thickness profile model further includes at least one of time filtering capability and spatial frequency filtering capability as part of calculating the target thickness profile.

25. The control architecture for controlling strip geometry in casting strip having a hot rolling mill of claim 15 where the differential strain feed back model includes an automatic nulling capability capable of subtracting out systematic errors from the differential strain feed back when the rolling mill is engaged, the systematic errors being generated through comparison of the entry and exit thickness profiles when the rolling mill is disengaged.

26. The control architecture for controlling strip geometry in casting strip having a hot rolling mill of claim 15 where the differential strain feed back model includes temperature compensation capability and buckle detection capability.

27. The control architecture for controlling strip geometry in casting strip having a hot rolling mill of claim 15 where the control architecture supports at least one of operator-induced coolant trimming and operator-induced bending trimming.

28. The control architecture for controlling strip geometry in casting strip having a hot rolling mill of claim 15 further comprising:

the target thickness profile model capable of calculating the target thickness profile as a function of a change in geometry of the metal strip to achieve the target thickness profile without producing local strip buckling.

* * * * *

UNITED STATES PATENT AND TRADEMARK OFFICE

CERTIFICATE OF CORRECTION

PATENT NO. : 8,205,474 B2
APPLICATION NO. : 12/332040
DATED : June 26, 2012
INVENTOR(S) : Richard Britanik et al.

It is certified that error appears in the above-identified patent and that said Letters Patent is hereby corrected as shown below:

Column 10, line 8, "H(X)*" should read --H(x)*--.

Signed and Sealed this
Twenty-eighth Day of August, 2012

David J. Kappos

David J. Kappos
*Director of the United States Patent and Trademark Office*